US006123811A

United States Patent [19]

Komarnycky et al.

[11] Patent Number: 6,123,811

[45] Date of Patent: Sep. 26, 2000

[54] METHOD OF MANUFACTURING AQUEOUS PAPER PULP FOR WATER SOLUBLE PACKAGES

[75] Inventors: Peter Komarnycky, Lebanon, N.J.; Robert J. Cerwin, Pipersville, Pa.

[73] Assignee: Ethicon, Inc., Somerville, N.J.

[21] Appl. No.: 09/211,701

[22] Filed: Dec. 14, 1998

[51] Int. Cl.[7] ..... D21H 11/20

[52] U.S. Cl. ..... 162/146; 162/141; 162/157.6; 162/173; 162/175; 162/177

[58] Field of Search ..... 162/141, 146, 162/157.1, 157.3, 157.6, 157.7, 158, 164.6, 168.2, 9, 173, 177, 175

[56] References Cited

U.S. PATENT DOCUMENTS

| | | | |
|---|---|---|---|
| 2,626,214 | 1/1953 | Osborne | 162/157.3 |
| 3,116,199 | 12/1963 | Cruz et al. | 162/157.6 |
| 3,340,139 | 9/1967 | Thomas et al. | 162/146 |
| 3,939,971 | 2/1976 | Tulis . | |
| 4,206,844 | 6/1980 | Thukamoto et al. . | |
| 4,972,017 | 11/1990 | Smith et al. . | |
| 5,180,614 | 1/1993 | Escabasse . | |
| 5,227,415 | 7/1993 | Masuda et al. . | |
| 5,444,107 | 8/1995 | Ajioka et al. . | |
| 5,444,113 | 8/1995 | Sinclair et al. . | |
| 5,458,072 | 10/1995 | Hughes et al. . | |
| 5,508,101 | 4/1996 | Patnode et al. . | |
| 5,509,913 | 4/1996 | Yeo . | |
| 5,536,807 | 7/1996 | Gruber et al. . | |
| 5,667,637 | 9/1997 | Jewell et al. | 162/146 |

*Primary Examiner*—Stanley S. Silverman
*Assistant Examiner*—Jose A. Fortuna
*Attorney, Agent, or Firm*—Emil Richard Skula

[57] ABSTRACT

An aqueous slurry for manufacturing water soluble or dispersible paper for use in medical device packaging. The slurry has a solid component consisting of methylcellulose and paper pulp. The slurry also has a liquid component consisting of water and an alkylalcohol. The methylcellulose remains in a substantially undissolved state in the aqueous slurry.

12 Claims, No Drawings

METHOD OF MANUFACTURING AQUEOUS PAPER PULP FOR WATER SOLUBLE PACKAGES

The field of art, to which this invention relates is water-dispersible paper pulps, more specifically, water-dispersible paper pulps useful for water soluble or dispersible medical device packaging.

BACKGROUND OF THE INVENTION

A medical device package typically consists of a paperboard, cardboard or plastic structure in which the medical device is packaged. A fundamental purpose of the packaging is to protect the medical device contained in the package from damage during shipping, handling and storage. In addition, such packages or packaging provide a protective barrier against environmental contaminants and against degradation, and frequently serve as a sterile barrier so that a sterile medical device remains in a sterile condition prior to use by the medical professional.

It is know that medical device packaging contributes significantly to the solid and medical waste that the typical hospital or medical practitioner must dispose of. Used medical device packaging often requires special disposal as regulated or "red-bagged" medical waste, with consequent increases in the costs of handling, storage and disposal for the hospital or medical practitioner.

There is a need in this art for medical device packaging that the hospital or medical practitioner could dispose of readily without having to dispose of it as regulated medical waste. In particular, medical device packaging made of materials which would be soluble and/or dispersible in water. The medical device packages made of such materials could then be disposed of by treatment in a device similar to a washing machine, a dishwasher or a garbage disposal. When contacted with water and agitated, the packaging materials would dissolve or disassociate to form a slurry or a dispersion, thereby permitting the resulting waste stream to be disposed of in the hospital's or medical practitioner's conventional sewer system which typically flows into a conventional treatment facility, publicly owned or private. The waste stream from the soluble or dispersible packaging would then be treated in the sewage treatment facility in a similar fashion to sanitary waste.

SUMMARY OF THE INVENTION

It is an object of the present invention to provide a method for manufacturing an aqueous paper pulp useful to manufacture a water soluble or dispersible paper, wherein the paper is useful in medical device packaging.

It is yet another object of the present invention to provide an aqueous paper pulp dispersion that can be used to manufacture a water soluble or dispersible paper, wherein the paper is useful in medical device packaging.

Accordingly, a method for manufacturing an aqueous paper pulp slurry is disclosed. Initially a slurry is formed in a mixing vessel. The slurry has a solid component and a liquid component. The solid component consists of up to about 4.0 wt. % of the weight of the entire slurry. The solid component has about 25 wt. % to about 75 wt. % of water-soluble methylcellulose based upon the weight of the solid component, and about 75 wt. % to about 25 wt. % of paper fiber based upon the weight of the solid component. The slurry has an aqueous liquid component that makes up the remainder of the slurry. The liquid component has about 25 wt. % to about 75 wt. % of water based upon the weight of the liquid component, and about 75 wt. % to about 25 wt. % of an alkyl alcohol based upon the weight of the liquid component. The solid and liquid components are mixed in the vessel to form an aqueous pulp slurry such that the methylcellulose does not dissolve in the slurry, wherein the slurry is useful for manufacturing a water dispersible or soluble paper.

Yet another aspect of the present invention is an aqueous pulp slurry useful for manufacturing a water soluble or dispersible paper. The slurry has a solid component and a liquid component. The solid component consists of up to about 4.0 wt. % of the weight of the entire slurry. The solid component has about 25 wt. % to about 75 wt. % of water-soluble methylcellulose based upon the weight of the solid component, and about 75 wt. % to about 25 wt. % of paper fiber based upon the weight of the solid component. The slurry has an aqueous liquid component that makes up the remainder of the slurry. The liquid component has about 25 wt. % to about 75 wt. % of water based upon the weight of the liquid component, and about 75 wt. % to about 25 wt. % of an alkyl alcohol based upon the weight of the liquid component. The solid and liquid components are mixed in the vessel to form an aqueous pulp slurry such that the methylcellulose does not dissolve in the slurry, wherein the slurry is useful for manufacturing a water dispersible or soluble paper.

Other features and advantages of the invention will become more apparent from the following description and examples.

BEST MODE FOR CARRYING OUT THE INVENTION

The water-soluble methylcellulose which can be used in the method of the present invention to form the aqueous slurries of the present invention will preferably consist of the methyl ether of cellulose containing between 25% and 35% methoxy groups. Such methyl cellulose is commercially available. Preferably, a commercial grade is used. Those skilled in the art will appreciate that other water soluble cellulosic products and equivalents thereof may be substituted for methyl cellulose.

The alkyl alcohols which can be used in the practice of the present invention include ethanol propanol, isopropanol, methanol, butanol and the like. It is particularly preferred to use to use isopropanol. The alkyl alcohols which can be utilized in the method of the present invention and the aqueous slurries of the present invention will typically be of a purity commonly known as commercial grade, although purer grades can be used.

The water used in the methods of the present invention is preferably filtered to remove contaminants. Deionized or distilled water can be substituted for greater purity of the aqueous slurry.

The paper fiber useful in the slurries and process of the present invention will typically consist of commercially available, conventional sulfate pulp and equivalents thereof.

The aqueous slurries of the present invention, which are useful to manufacture water dispersible papers, are manufactured in the following manner. Typically, into a conventional vessel having a conventional mixing agitator is added a sufficient amount of a solid component sufficient to provide an effective aqueous slurry. The solid component will consist of up to 4.0 wt. % of the entire weight of the slurry. The solid component will have a sufficient amount of methylcellulose effective to produce a slurry which is effective to manufacture a water soluble or dispersible paper.

Typically about 25 wt. % to about 75 wt. % of methylcellulose based upon the total weight of the solid component is used, preferably about 50 wt. %. The solid component will have a sufficient amount of paper pulp effective to produce a slurry which is effective to manufacture a water soluble or dispersible paper. Typically about 75 wt. % to about 25 wt. % of pulp based upon the total weight of the solid component is used, preferably about 50 wt. %. The methylcellulose remains in an undissolved state.

A sufficient quantity of a liquid component is added to the mixing vessel effective to provide and aqueous slurry that is effective to manufacture a water dispersible or soluble paper. The remainder of the of the slurry consists of the liquid component. The liquid component consists of sufficient amounts of water and an alkyl alcohol effective to provide for a slurry that is effective to manufacture a water soluble or dispersible paper. The liquid component will consist of typically about 25 wt. % to about 75 wt. % of alkyl alcohol based upon the total weight of the liquid component, preferably about 50 wt. %. The liquid component will also contain about 25 wt. % to about 75 wt. % of water based upon the total weight of the liquid component, preferably about 50 wt. %. Then the components are mixed in the mixing vessel for a sufficient amount of time to effectively form a pulp slurry useful in manufacturing a water dispersible paper. It will be appreciated by those skilled in the art that it will be preferable to add the liquid component first to the mixing vessel and the solid component thereafter. The solid and liquid components are sufficiently agitated or mixed in the vessel for a sufficient amount of time effective to produce an aqueous slurry effective to manufacture a water soluble or dispersible paper. The methylcellulose component remains in a substantially undissolved state.

The aqueous slurries of the present invention will contain a solid component and a liquid component. Sufficient amounts of the solid and liquid components will be present to form a slurry of the present invention effective for manufacturing a water soluble or dispersible paper. Up to about 4.0 wt. % of the solid component based upon the weight of the entire slurry will be used. The solid component will contain a sufficient amount of methylcellulose to effectively provide for an aqueous slurry of the present invention that is effective to manufacture a water soluble or dispersible paper. Typically the amount of methylcellulose in the solid component will be about 25 wt. % to about 75 wt. % based upon the weight of the solid component, preferably about 50 wt. %. The solid component will also contain a sufficient amount of paper pulp to effectively provide for a slurry that is effective to manufacture a water soluble or dispersible paper. Typically the amount of paper pulp in the solid component will be about 25 wt. % to about 75 wt. % based upon the weight of the solid component, preferably about 50 wt. %. The slurry will also contain a liquid component. The remainder of the slurry will be the liquid component. The liquid component will contain sufficient amounts of water and an alkylalcohol to effectively provide for an aqueous slurry of the present invention. The amount of water in the liquid component of the slurries of the present invention will be sufficient to effectively provide a slurry that is effective to manufacture a paper in a conventional paper manufacturing process. Typically the amount of water will be about 25 wt. % to about 75 wt. % based upon the weight of the liquid component, preferably about 50 wt. %. The amount of alkylalcohol in the liquid component of the slurries of the present invention will be sufficient to effectively provide a slurry that can be useful to manufacture a paper in a conventional paper manufacturing process. Typically the amount of alkylalcohol will be about 25 wt. % to about 75 wt. % based upon the weight of the liquid component, preferably about 50 wt. %. The methylcellulose in the slurry remains in a substantially undissolved state.

One method of manufacturing paper using the dispersions or slurries of the present invention is to pump or pour the dispersions onto a screen and to pull a vacuum on the screen to separate the liquid components from the slurry and to leave behind a structure comprising pulp fiber and methylcellulose. Other conventional paper manufacturing techniques and processes can be used including Fourdrinier, rotary formers, twin wire former and combinations of the about. However, any conventional paper manufacturing process may be utilized to manufacture the medical device packaging from the slurries of the present invention. Paper made using the slurries of the present invention is easily dispersed by placing the paper in water with effective agitation.

The following example is illustrative of the principles of practice of the present invention, although not limited thereto.

EXAMPLE

A slurry of the present invention was manufactured using the method of the present invention in the following manner. To a conventional laboratory blender containing a conventional agitator was added the following liquid component: about 50 parts by weight of water and 50 parts by weight of isopropanol. Added to the liquid component was the following solid component: about 50 parts by weight of methylcellulose and about 50 parts by weight of paper fiber. The paper fiber consisted of bond paper that was cut into strips approximately 0.5 inches by 1.0 inches. The mixture was then agitated in the blender until a uniform dispersion was obtained to form an aqueous pulp slurry. Then, the slurry was poured from the blender onto a conventional papermaking screen. A vacuum was pulled on the screen until most of the liquid components had separated from the solid components, leaving behind a "wet" paper residue on the screen. The wet paper residue was compressed between two plates to remove additional alcoholic solution. The paper was removed from the screen and dried in an over at a temperature of about 60° C. for about 4 hours. To test the dispersability of the paper in water, the following procedure was conducted: the paper was dropped into a beaker of tap water without agitation and observed to swell and disperse. Surprisingly and unexpectedly, the use of the isopropanol had the following effect: it allowed the formation of an aqueous pulp slurry with both the methylcellulose and standard paper fiber. Isopropanol by itself would not allow the formation of a slurry that could be used to make paper. Water by itself would dissolve the methylcellulose and would not allow the formation of a usable aqueous pulp.

The method of manufacturing a slurry in the slurries of the present invention have many advantages. These advantages include the ability to combine methylcellulose with pulp fibers in an aqueous paper making process to form a water soluble or dispersible paper. The resulting paper product can be used as a standard packaging material for medical devices. Packages made from this paper product effortlessly breakdown in the presence of water for disposal through a typical sewage system. It is surprising and unexpected that aqueous pulp slurries can be formed using methylcellulose which maintain the methylcellulose in an undissolved state such that the slurries are useful to form water soluble or dispersible paper.

Although this invention has been shown and described with respect to the detailed embodiments thereof, it will be understood by those skilled in the art that various changes in form and detail thereof may be made without departing from the spirit and scope of the claimed invention.

What is claimed is:

1. A method for manufacturing a water dispersible paper pulp comprising:

forming a slurry in a vessel, said slurry comprising:

A) a solid component, the solid component comprising about 25 wt. % to about 75 wt. % of a water soluble methylcellulose based upon the total weight of the solid component, and, about 75 wt. % to about 25 wt. % of paper pulp based upon the total weight of the solid component, wherein the solid component comprises 4.0 wt. % or less of the total weight of the slurry; and, B) the remainder of the slurry comprising a liquid component, the liquid component comprising about 25 wt. % to about 75 wt. % of an alkyl alcohol based upon the total weight of the liquid component and about 75 wt. % to about 25 wt. % of water based upon the total weight of the liquid component; and, mixing the ingredients in the vessel to produce an aqueous pulp slurry, wherein said water soluble methyl cellulose remains substantially in an undissolved state in the slurry.

2. The method of claim 1 wherein the alkyl alcohol is selected from the group consisting of ethanol, methanol, butanol, propanol, isopropanol and combinations thereof.

3. The method of claim 1 wherein the alkyl alcohol is isopropanol.

4. The method of claim 1 wherein the solid component comprises 50 wt. % of said water soluble methyl cellulose.

5. The method of claim 1 wherein the liquid component comprises 50 wt. % isopropanol.

6. The method of claim 1 wherein the paper pulp comprises sulfate pulp.

7. An aqueous slurry for manufacturing a water dispersible paper, said slurry comprising:

A) a solid component, the solid component comprising about 25 wt. % to about 75 wt. % of said water soluble Methyl Cellulose based upon the total weight of the solid component, and, about 75 wt. % to about 25 wt. % of paper pulp based upon the total weight of the solid component, wherein the solid component comprises 4.0 wt. % or less of the total weight of the slurry; and, B) the remainder of the slurry comprising a liquid component, the liquid component comprising about 25 wt. % to about 75 wt. % of an alkyl alcohol based upon the total weight of the liquid component and about 75 wt. % to about 25 wt. % of water based upon the total weight of the liquid component, wherein said water soluble methylcellulose remains substantially in an undissolved state in the slurry.

8. The slurry of claim 7 wherein the alkyl alcohol is selected from the group consisting of ethanol, methanol, butanol, propanol, isopropanol and combinations thereof.

9. The slurry of claim 7 wherein the alkyl alcohol is isopropanol.

10. The slurry of claim 7 wherein the solid component comprises 50 wt. % of said water soluble methyl cellulose.

11. The slurry of claim 7 wherein the liquid component comprises 50 wt. % isopropanol.

12. The slurry of claim 7 wherein the paper pulp comprises sulfate pulp.

* * * * *